US009510414B2

(12) United States Patent
Kim et al.

(10) Patent No.: US 9,510,414 B2
(45) Date of Patent: Nov. 29, 2016

(54) LIGHT EMITTING DIODE DRIVING CIRCUIT AND LIGHTING APPARATUS HAVING THE SAME

(71) Applicant: Magnachip Semiconductor, Ltd., Cheongju-si (KR)

(72) Inventors: Hae Wook Kim, Bucheon-si (KR); Brent Rowe, Cupertino, CA (US); Hyun Jung Kim, Seoul (KR); Paul Greenland, Cupertino, CA (US); Seung Hwan Lee, Seoul (KR)

(73) Assignee: Magnachip Semiconductor, Ltd., Cheongju-si (KR)

( * ) Notice: Subject to any disclaimer, the term of this patent is extended or adjusted under 35 U.S.C. 154(b) by 0 days.

(21) Appl. No.: 14/740,524

(22) Filed: Jun. 16, 2015

(65) Prior Publication Data

US 2016/0100466 A1 Apr. 7, 2016

(30) Foreign Application Priority Data

Oct. 1, 2014 (KR) ..... 10-2014-0132264

(51) Int. Cl.
*H05B 39/04* (2006.01)
*H05B 33/08* (2006.01)

(52) U.S. Cl.
CPC ..... *H05B 33/0845* (2013.01); *H05B 33/0818* (2013.01)

(58) Field of Classification Search
CPC ..... H05B 33/08; H05B 37/02
USPC ..... 315/307–308, 200 R, 209 R, 312, 185 R
See application file for complete search history.

(56) References Cited

U.S. PATENT DOCUMENTS

2011/0309759 A1* 12/2011 Shteynberg ..... H05B 33/0815 315/201
2012/0155889 A1* 6/2012 Kim ..... H04B 10/116 398/193
2012/0286684 A1* 11/2012 Melanson ..... H02M 1/4225 315/224
2012/0319608 A1* 12/2012 Xu ..... H02M 1/44 315/208
2014/0265935 A1* 9/2014 Sadwick ..... H05B 33/0815 315/307

FOREIGN PATENT DOCUMENTS

KR 10-2013-0120421 11/2013

* cited by examiner

*Primary Examiner* — Minh D A

(57) ABSTRACT

A light emitting diode (LED) driving circuit includes a flicker elimination unit configured to perform a flicker removal for LED modules and a driving control unit configured to pause a procedure of the flicker removal based on an AC input voltage that is regulated through a Triode for Alternating Current (TRIAC) dimmer, so as to cause a brightness of the LED modules to be dimmed. Therefore, the LED driving circuit selectively adjusts an LED brightness level and removes LED flicker by using a TRIAC dimmer and controls the brightness level of the LED module based on a dimming level.

20 Claims, 4 Drawing Sheets

LIGHT EMITTING DIODE DRIVING CIRCUIT AND LIGHTING APPARATUS HAVING THE SAME

CROSS-REFERENCE TO RELATED APPLICATIONS

This application claims the benefit under 35 U.S.C. §119 (a) of Korean Patent Application No. 10-2014-0132264 filed on Oct. 1, 2014, in the Korean Intellectual Property Office, the entire disclosure of which is incorporated herein by reference for all purposes.

BACKGROUND

1. Field

The following description relates to a light emitting diode (LED) driving technology. The following description also relates to an LED driving circuit and lighting apparatus using such a technology for performing an adjustment of an LED brightness level and a removal of an LED flicker through a Triode for Alternating Current (TRIAC) dimmer.

2. Description of Related Art

An LED (light emitting diode) lighting apparatus is an environmental-friendly light source of a lighting system that has an advantage in that it is able to endure a pressure and/or a vibration. The LED lighting apparatus also has the properties that it is easy to regulate a brightness of an LED and an LED has a high speed response. Furthermore, because the brightness of the LED lighting apparatus is easily regulated, a quantity of consumed electricity in standby state may be reduced by reducing the LED's brightness and the LED lighting apparatus may thus be able to save energy. Hence, the LED lighting apparatus may decrease a power consumption compared with an alternative lighting source to replace the alternative lighting apparatus. An example LED lighting apparatus may use an AC-type direct driving circuit to directly use an alternating current in lieu of direct current.

In the case of the alternative lighting apparatus, switching of a power switch controls operation of the lighting apparatus. A dimming level of a next section is potentially determined based on a dimming level of a previous section or based on a turn-on time of the power switch. In other words, the alternative LED lighting apparatus requires the power switch be provided separately for driving of an LED.

However, an AC direct-coupled method is potentially preferred because it offers advantages of lightness and small size so as to be preferred to a DC power method. As a range of use of such an AC direct-coupled lighting apparatus becomes wider, a flicker and decline of lamp efficiency may occur during operation of such an apparatus. The flicker may arise as a result of a situation in which turn-on driving points are different from each other. Thus, a time difference in light emission may lead the LED to flicker. Such flickering may cause an LED user to feel tired. For improved management of the flicker, a capacitive element having a large capacity is used. However, use of such a capacitive element leads to the occurrence of a problem of a decrease of a power-factor.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Examples selectively perform an adjustment of an LED brightness level and a removal of an LED flicker by using a TRIAC dimmer.

Also, examples control a brightness of an LED module by controlling a dimming level.

In one general aspect, a light emitting diode (LED) driving circuit includes a flicker elimination unit configured to perform a flicker removal for LED modules, and a driving control unit configured to pause a procedure of the flicker removal in response to an AC input voltage being received through a Triode for Alternating Current (TRIAC) dimmer.

The flicker elimination unit may include a diode element, a transistor element and a capacitive element.

The flicker elimination unit may be configured to improve a power factor by using the capacitive element to reduce a power loss.

The driving control unit may include a signal detection module configured to detect a selection signal received from an internal source or external source, and a control signal supply module configured to provide a control signal for activating the flicker elimination unit based on the detection result of the selection signal.

The signal detection module may count a number of oscillations output by an oscillator during one cycle of an AC input voltage to determine whether the selection signal is a TRIAC dimming signal.

The control signal supply module may provide the control signal to activate the flicker elimination unit in response to the selection signal not being a TRIAC dimming signal and does not provide the control signal in response to the selection signal being a TRIAC dimming signal.

The driving control unit may select a TRIAC-dimming mode using the TRIAC dimmer or a flicker-free mode using the flicker elimination unit through the control signal.

The circuit may further include a dimming level control unit configured to control a brightness level of the plurality of LED modules by controlling a dimming level.

The dimming level control unit may receive a dimming signal from an outside source or an inside source in order to control the brightness level of the plurality of LED modules using an analog-dimming level or Pulse Width Modulation (PWM) dimming level of the dimming signal.

The dimming level control unit may set an amplitude of a driving current as a predetermined amplitude level in response to the dimming signal being provided from an internal source.

The dimming level control unit may control an amplitude level of a driving current in response to the dimming signal being an external analog dimming signal and controls an amplitude level or frequency level of the driving current provided that the dimming signal is an external Pulse Width Modulation (PWM) dimming signal.

The circuit may further include a driving current control unit configured to control a driving current set based on whether the control signal is provided and based on the dimming level.

The driving control unit may control a path of a driving current flowing into the LED modules.

In another general aspect, a light emitting diode (LED) lighting apparatus includes LED modules, a bridge diode configured to full-wave rectify an AC input voltage, a Triode for Alternating Current (TRIAC) dimmer configured to adjust a brightness level of the LED modules, and a LED driving circuit configured to drive the LED modules wherein the LED driving circuit comprises a flicker elimination unit configured to perform a flicker removal for the LED modules, and a driving control unit configured to pause a procedure of the flicker removal in response to an AC input voltage being received through the Triode for Alternating Current (TRIAC) dimmer.

The LED driving circuit may further include a dimming level control unit configured to control a brightness level of the LED modules by controlling a dimming level.

The light emitting diode (LED) driving circuit further includes a driving current control unit configured to control a driving current set based on whether a control signal is provided and a dimming level.

In another general aspect, a driving method of an light emitting diode (LED) driving circuit includes detecting a selection signal, determining whether the selection signal is a Triode for Alternating Current (TRIAC) dimming signal, and in response to determining that the selection signal is a TRIAC dimming signal, providing a control signal to perform flicker removal.

The driving method may further include detecting whether a dimming signal is provided from an outside source, and in response to detecting that a dimming signal is provided from an outside source, controlling an amplitude or frequency level of a driving current.

The driving method may further include determining whether a dimming signal is provided from an inside source, and in response to determining that a dimming signal is provided from an inside source, setting an amplitude of the driving current to be a predetermined amplitude level.

The driving method may further include controlling a path of the driving current.

Thus, the light emitting diode (LED) driving circuit and the LED lighting apparatus having the same according to an example adjust a brightness of a LED module and remove a flicker.

Also, the light emitting diode (LED) driving circuit and the LED lighting apparatus having the same according to an example control a brightness level of a LED module by controlling a dimming level.

Other features and aspects will be apparent from the following detailed description, the drawings, and the claims.

Figure 1:
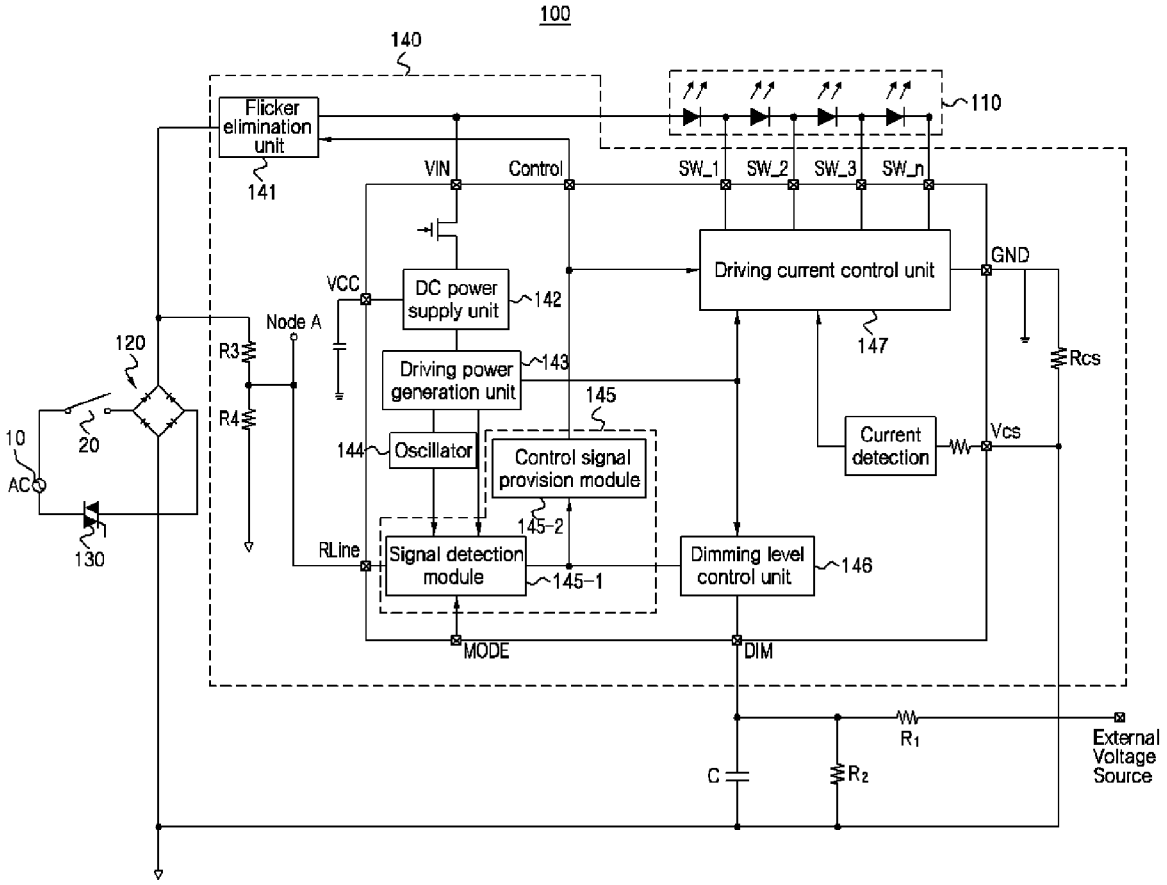
FIG. 1 is a circuit diagram illustrating a light emitting diode driving circuit of a LED lighting apparatus according to an example.

Throughout the drawings and the detailed description, unless otherwise described or provided, the same drawing reference numerals will be understood to refer to the same elements, features, and structures. The drawings may not be to scale, and the relative size, proportions, and depiction of elements in the drawings may be exaggerated for clarity, illustration, and convenience.

DETAILED DESCRIPTION

The following detailed description is provided to assist the reader in gaining a comprehensive understanding of the methods, apparatuses, and/or systems described herein. However, various changes, modifications, and equivalents of the systems, apparatuses and/or methods described herein will be apparent to one of ordinary skill in the art. The progression of processing steps and/or operations described is an example; however, the sequence of and/or operations is not limited to that set forth herein and may be changed as is known in the art, with the exception of steps and/or operations necessarily occurring in a certain order. Also, descriptions of functions and constructions that are well known to one of ordinary skill in the art may be omitted for increased clarity and conciseness.

The features described herein may be embodied in different forms, and are not to be construed as being limited to the examples described herein. Rather, the examples described herein have been provided so that this disclosure will be thorough and complete, and will convey the full scope of the disclosure to one of ordinary skill in the art.

Explanation of the examples is merely intended to provide structural or functional explanations of specific examples, so the scope of potential examples is not to be construed to be limited to the specific examples that are explained.

Terms described in the present disclosure are to be understood as follows.

While terms such as "first" and "second," etc., are used to describe various components, such components are not to be understood as being limited to the above terms. The above terms are used only to distinguish one component from another. For example, such terms are not intended to imply an ordering of components, unless such a relationship is specifically described.

Further, it is to be understood that when an element is referred to as being "connected to" another element, such an element is directly connected to the other element in some examples, but intervening elements also are potentially present in other examples. In contrast, when an element is referred to as being "directly connected to" another element, no intervening elements are present. In addition, unless explicitly described to the contrary, the word "comprise" and variations such as "comprises" or "comprising," are to be understood to imply the inclusion of stated elements but not the exclusion of any other elements. Meanwhile, other expressions describing relationships between components such as "~ between", "immediately ~ between" or "adjacent to ~" and "directly adjacent to ~" are to be construed similarly.

Singular forms "a", "an" and "the" in the present disclosure are intended to include the plural forms as well, unless the context clearly indicates otherwise. It is to be further understood that terms such as "including" or "having," etc., are intended to indicate the existence of the features, numbers, calculations, actions, components, parts, or combinations thereof that are disclosed in the specification, and are not intended to preclude the possibility that one or more other features, numbers, calculations, actions, components, parts, or combinations thereof potentially exist or are potentially added.

FIG. 1 is a circuit diagram illustrating a light emitting diode driving circuit of a LED lighting apparatus according to an example.

Referring to FIG. 1, an LED light apparatus 100 includes an AC input power 10, a power switching element 20, a plurality of LED modules 110, a bridge diode 120, a TRIAC dimmer 130 and a LED driving circuit 140.

The AC input power 10 corresponds to a source of an AC input voltage VIN. In an example, a frequency of the AC input voltage VIN corresponds to 50 Hz or 60 Hz according to a power provider. However, in other examples, the frequency of the AC input voltage VIN corresponds to a different value. Also, in some examples, the frequency fluctuates according to a current distribution system.

In the example of FIG. 1, the power switching element 20 is electrically coupled to the AC input power 10 and the bridge diode 110 to supply an electric power to the LED driving circuit 140. The power switch element 20 determines an operating section of the plurality of the LED modules 110. Thus, a dimming level of a next operating section thereof is determined based on a dimming level of a previous operating section thereof and a turn-on time of the power switching element 20. In an example, a reference time range is predetermined for changing the turn-on time of the power switching element 20. In one example, when the turn-on time of the power switching element 20 is within the reference time range in the previous operating section thereof, the turn-on time is changed. However, when the turn-on time of the power switching element 20 falls beyond the reference time range in the previous operating section, the turn-on time is maintained.

In the example of FIG. 1, the plurality of LED modules 110 is configured to include N groups including series-coupled, parallel-coupled or serial and parallel coupled LEDs. The plurality of LED modules 110 receives the AC input voltage VIN, after VIN has been full-wave rectified in the bridge diode 120, to be driven through the driving current control unit 147. Also, in such an example, the plurality of LED modules 110 is driven during a turn-on time of the power switching element 20.

In the example of FIG. 1, the bridge diode 120 is electrically coupled to the AC input power 10 and is configured to include a plurality of diode modules connected with each other. In the example of FIG. 1, the bridge diode 120 acts to full-wave rectify the AC input voltage VIN. The full-wave rectified AC input voltage VIN is supplied to the plurality of LED modules 110.

In the example of FIG. 1, the TRIAC dimmer 130 is series-coupled to the AC input power 10 and the bridge diode 120. The TRIAC dimmer 130 changes an angle to adjust a brightness of the plurality of LED modules 110. In one example, the TRIAC dimmer 130 requires a minimum holding current having a value of about 30 mA to 50 mA. However, in response to a condition that the TRIAC dimmer 130 does not maintain the minimum holding current, a flicker in the plurality of the LED 110 potentially occurs.

The light emitting diode (LED) driving circuit 140 includes a flicker elimination unit 141, a DC power supply unit 142, a driving power generation unit 143, an oscillator 144, a driving control unit 145, a dimming level control unit 146 and a driving current control unit 147.

In the example of FIG. 1, the flicker elimination unit 141 includes a diode element, a transistor element and a capacitive element. The flicker elimination unit 141 removes the flicker in the plurality of the LED modules 110. In one example, the flicker elimination unit 141 uses a transistor element including a capacitive element having a relatively low capacity, thereby improving a power factor of the LED driving circuit 140. As a result, the flicker elimination unit 141 improves the power factor of the LED driving circuit 140, reducing power loss.

The DC power supply unit 142 supplies a DC voltage VCC required to drive the LED driving circuit 140. Thus, the DC voltage VCC gradually increases as an externally connected capacitive element is charged.

The driving power generation unit 142 is coupled to the DC input power 142 to receive the DC voltage VCC. The driving power generation unit 143 generates a driving voltage VDD (not shown) and produces an enable signal EN (not shown), provided that the DC voltage VCC is larger than a predetermined voltage. Upon a condition that the enable signal EN (not shown) is applied, the driving voltage VDD (not shown) is provided to each of the elements in the LED driving circuit 140.

In one example, the oscillator 144 receives the driving voltage VDD from the driving power generation unit 143, so as to maintain an output at a constant level. The oscillator 144 outputs a clock signal for detecting a selection signal. The output clock signal is provided to the driving control unit 145.

The dimming level control unit 146 receives the dimming signal from the outside source through a DIM pin. Thus, the DIM pin is electrically coupled to an external voltage source through at least one resistor and at least one capacitive element. In one example, provided that a capacity of the capacitive element C located between the DIM pin and the external voltage source is big, RC delay may occur. A PWM (Pulse Width Modulation) dimming signal of the external voltage source is converted to an analog dimming signal by RC delay to be provided to the DIM pin. That is, the dimming level control unit 146 may control an amplitude level based on the PWM dimming signal from the outside source.

The driving control unit 145 pauses a procedure of the flicker elimination upon a condition that the AC input voltage is received through the TRIAC dimmer 130. Thus, the driving control unit 145 pauses a procedure of the flicker elimination upon a condition that an angle of the AC input voltage is regulated through the TRIAC dimmer 130 to cause a brightness of the plurality of the LED modules 110 to be dimmed. In this example, the driving control unit 145 includes a signal detection module 145-1 and a control signal supply module 145-2.

The signal detection module 145-1 detects a selection signal from an internal or external source.

Figure 2:
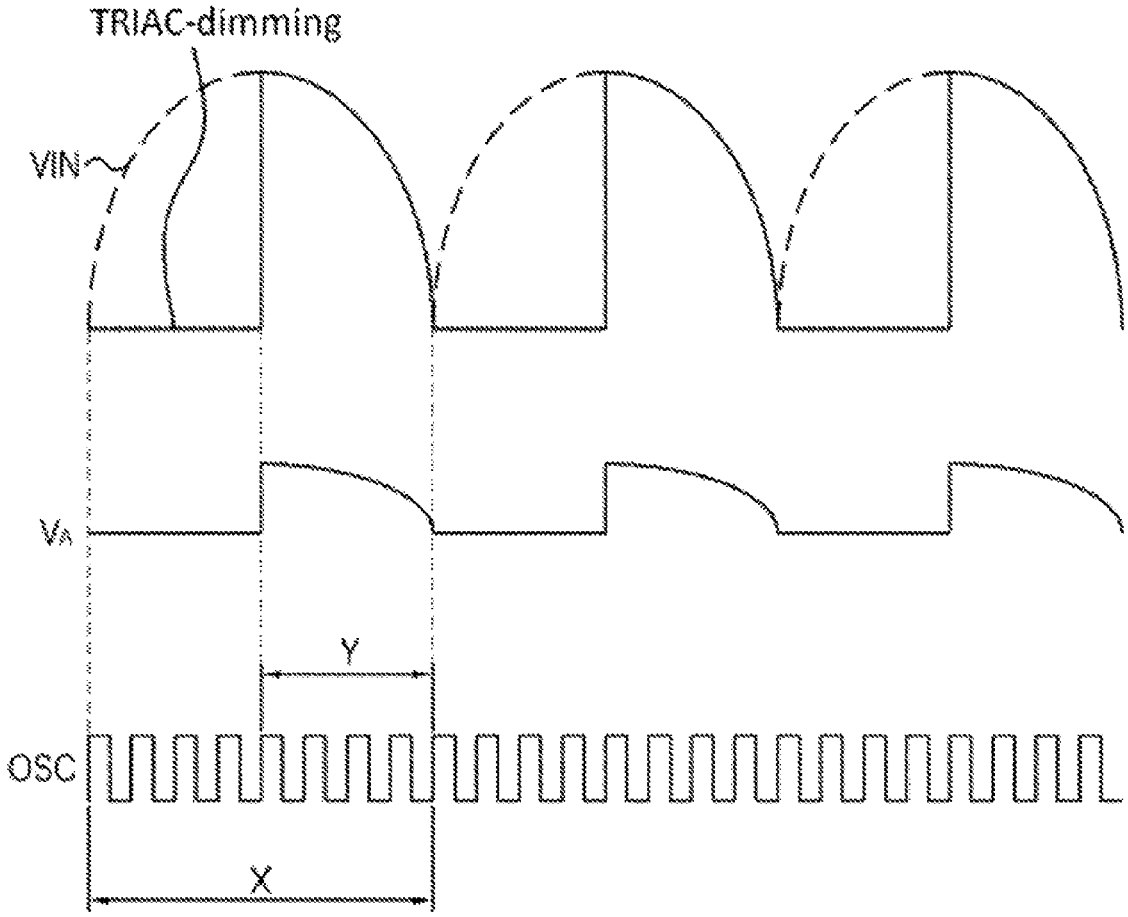
FIG. 2 is a timing diagram illustrating an operation principle of a signal detection module in the example of FIG. 1.

FIG. 2 is a timing diagram illustrating an operation principle of a signal detection module in the example of FIG. 1.

Referring to FIG. 2, the signal detection module 145-1 receives an internal selection signal so as to determine whether the internal signal is the TRIAC-dimming signal or not. Thus, the signal detection module 145-1 receives a distribution voltage $V_A$ of a node A. For example, the distribution voltage $V_A$ is generated through a distribution of resistance of an AC input voltage VIN. Hence, the AC input voltage VIN and distribution voltage $V_A$ having waveforms of different amplitudes and a same phase are generated so as to have an identical period. Because the amplitude of the AC input voltage VIN is excessively large for being provided to the signal detection module 145-1, the signal detection module 145-1 smoothly operates using the distribution voltage $V_A$.

Meanwhile, the oscillator 144 generates the clock signal to provide the clock signal to the signal detection module 145-1. In an example, a counted number of oscillations output by the oscillator during one cycle correspond to the internal selection signal, that is, a digital value. Thus, the signal detection module 145-1 counts the output of the oscillator, for example, the clock signal during the one cycle of the distribution voltage $V_A$ to determine whether the internal signal is the TRIAC dimming signal. For example, in response to a condition that the AC input voltage VIN is not received through the TRIAC dimmer 130, the internal selection signal is assumed to be an X and in response to a condition that the AC input voltage VIN is received through the TRIAC dimmer 130, the internal selection signal is assumed to be a Y. That is, the internal selection signal X is a count of a number of oscillator oscillations output during one cycle of the fully-rectified AC input voltage VIN on the condition that the angle of the fully-rectified AC input voltage Vin is regulated through the TRIAC dimmer 130 and the internal selection signal Y is a count of a number of a number of oscillator oscillations output during one cycle of the fully-rectified AC input voltage VIN on the condition that the angle of the fully-rectified AC input voltage VIN is not regulated through the TRIAC dimmer 130. Provided that the internal selection signal is the X, the signal detection module 145-1 decides that the signal is not the TRIAC dimming signal and the signal detection module 145-1 decides that the signal is the TRIAC dimming signal provided that the internal selection signal is the Y. Meanwhile, in an example, the signal detection module 145-1 receives the external selection signal through a MODE pin. Provided that the signal detection module 145-1 receives the external selection signal, the signal detection module 145-1 determines whether the signal is the TRIAC dimming signal or not through an identical procedure with respect to the internal selection signal reception.

In FIG. 1, the control signal supply module 145-2 provides the control signal for driving the flicker elimination unit 141 based on a result of the selection signal detection. Further, in such an example, provided that the TRIAC dimming signal is detected in the signal detection module 145-1, the control signal supply module 145-2 does not provide the control signal. However, provided that the TRIAC dimming signal is not detected in the signal detection module 145-1, the control signal supply module 145-2 provides the control signal to the flicker elimination unit 141.

A TRIAC dimming mode indicates that the light emitting diode (LED) driving circuit 140 is driven through the AC input voltage VIN received through the TRIAC dimmer 130. Because the TRIAC dimming signal is detected in the signal detection module 145-1 in the TRIAC dimming mode, in an example the control signal supply module 145-2 does not provide the control signal to the flicker elimination unit 141. That is, the flicker elimination unit 141 is not operated in the TRIAC dimming mode.

A flicker free mode indicates that the light emitting diode (LED) driving circuit 140 is driven through the AC input voltage VIN not received through the TRIAC dimmer 130. Because the TRIAC dimming signal is not detected in the signal detection module 145-1 in the flicker free mode, the control signal supply module 145-2 provides the control signal to the flicker elimination unit 141. That is, in one example, the flicker elimination unit 141 is operated in the flicker free mode. As a result, the driving control unit 145 selects the TRIAC dimming mode using the TRIAC dimmer 130 or the flicker free mode using the flicker elimination unit 141 through the control signal. The LED driving circuit 140 is driven according to a selected mode.

Figure 3:
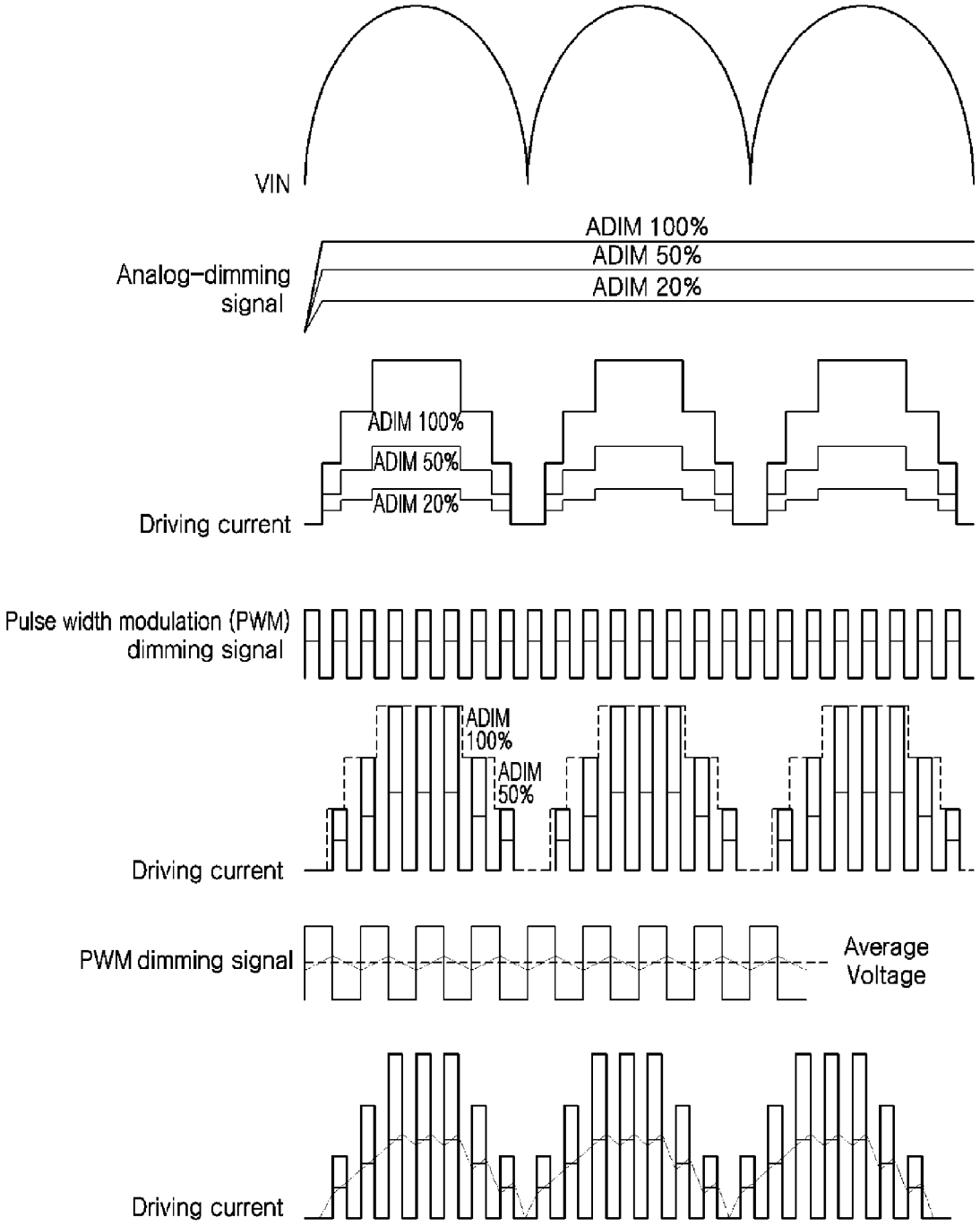
FIG. 3 is a timing diagram illustrating an operation principle of a dimming level control unit in the example of FIG. 1.

FIG. 3 is a timing diagram illustrating an operation principle of a dimming level control unit in the example of FIG. 1.

Referring to FIG. 3, a dimming level control unit 146 regulates a brightness level of the plurality of LED modules by controlling a dimming level. The dimming level control unit 146 receive a dimming signal from an outside or inside source so as to control the brightness level of the plurality of LED modules through an analog-dimming level or PWM (Pulse width modulation) dimming level of the dimming signal.

The dimming level control unit 146 receives the dimming signal from the outside source through a DIM pin. Provided that the dimming signal from the outside source is the analog dimming signal, the dimming level control unit 146 controls an amplitude level of a driving current. For example, if the amplitude level of the analog dimming signal is about 50% of a maximum amplitude, the amplitude level of the driving current is also, correspondingly, 50% of the maximum amplitude. That is, the dimming level control unit 146 regulates the amplitude level of the analog-dimming signal so as to control the brightness level of the plurality of LED modules 110.

Provided that the dimming signal from the outside source is the pulse width modulation (PWM) dimming signal, the dimming level control unit 146 controls an amplitude level or a frequency level of the driving current. In one example, provided that a capacity of the capacitive element C located between the DIM pin and the external voltage source is big, RC delay may occur. The PWM dimming signal of the external voltage source is converted to an analog dimming signal by RC delay to be provided to the DIM pin. For example, if the amplitude level of the FWM dimming signal is about 20% of the maximum amplitude, the amplitude level of the driving current is also, correspondingly, 20% of the maximum amplitude. Furthermore, in such an example, if the frequency level of the FWM dimming level is a 60 Hz frequency, the frequency level of the driving current is also a 60 Hz signal. The driving current flows through the plurality of LED modules 110 only when the FWM signal has a high level, namely, a positive number. Therefore, the plurality of LED modules 110 repeats a turn-on and turn-off during a short time range. Thus, the dimming level control unit 146 controls the amplitude level and/or frequency level of the FWM dimming signal so as to regulate the brightness level and the power consumption of the plurality of LED modules 110.

However, the dimming level control unit 146 sets the amplitude of the driving current as a predetermined amplitude level on a condition that the dimming signal is from the inside source. Hence, if there is no external dimming signal, the plurality of LED modules 110 is driven according to the driving current having the predetermined amplitude level.

Referring to the example of FIG. 1, the driving current control unit 147 controls the drive current that is set based on whether the control signal is provided or not and the dimming level. Thus, the light emitting diode (LED) driving circuit 140 is driven in the TRIAC dimming mode or a flicker free mode according to whether the control signal is provided. Also, in an example, the LED driving circuit 140 receives the dimming signal from the inside or outside source to control the dimming level of the driving current. In such an example, the plurality of LED modules 110 is driven in the selected mode through the control signal. The driving current control unit 147 controls a path of the driving current flowing into the plurality of the LED modules 110 so as to cause the driving current to flow into all or a part of the plurality of LED modules 110. As a result, the LED driving circuit 140 controls the brightness level of the plurality of LED modules 110 and randomly selects the plurality of LED modules 110 so as to drive the LED modules.

Figure 4:
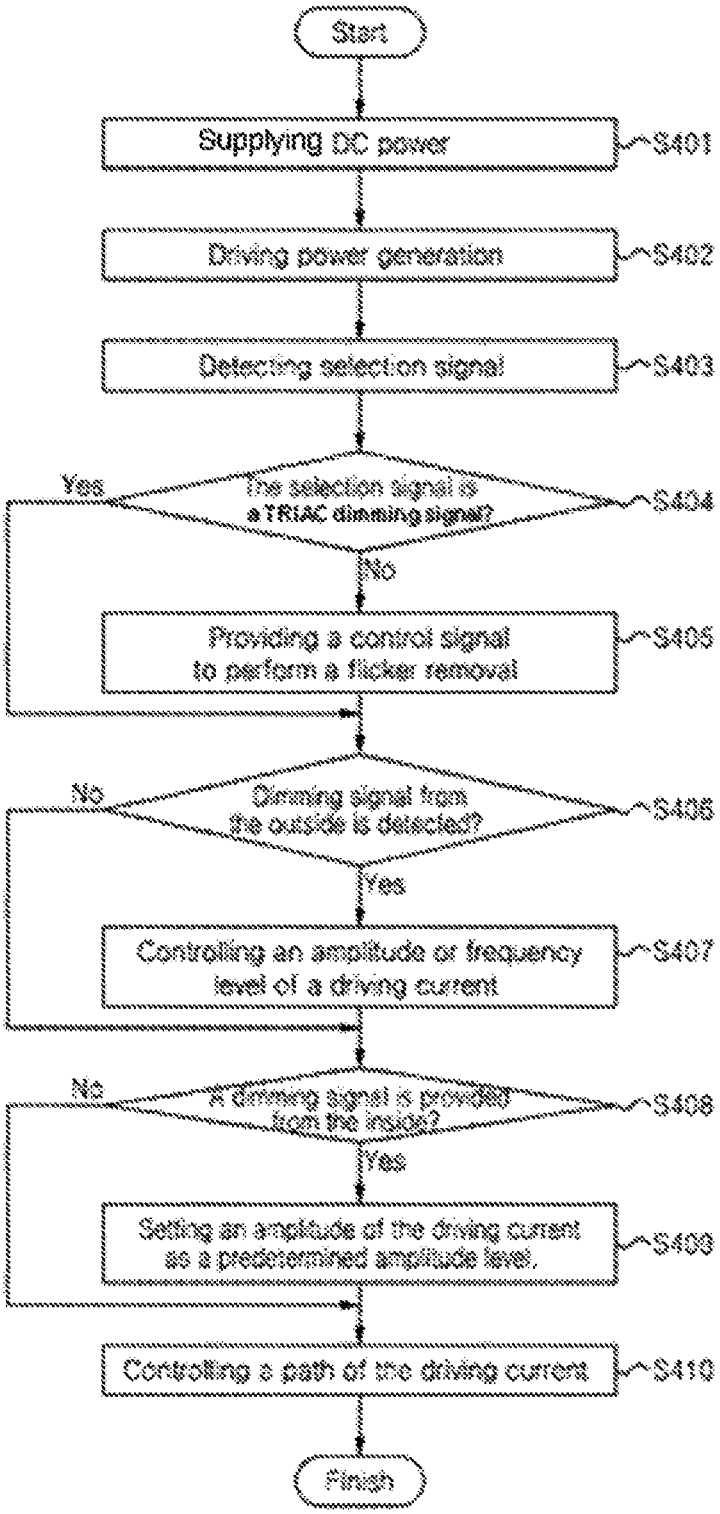
FIG. 4 is a flowchart illustrating a driving method of the LED driving circuit according to an example.

FIG. 4 is a flowchart illustrating a driving method of the LED driving circuit according to an example.

In operation S401, the method supplies DC power. For example, the DC input power 142 supplies the DC voltage Vcc for driving the light emitting diode (LED) driving circuit 140.

In operation S402, the method drives power generation. For example, the driving power generation unit 143 is coupled to the DC input power 142 to receive the DC voltage Vcc. The driving power generation unit 143 generates the driving voltage VDD based on a condition that the DC voltage Vcc is larger than a certain voltage. In an example, the certain voltage is a predefined threshold voltage. For example, the driving voltage VDD is supplied for each one of the elements of the LED driving circuit 140.

In operation S403, the method detects a selection signal. For example, the signal detection module 145-1 receives the selection signal from the inside source through the oscillator 144 and the node A of from the outside source through a MODE pin.

In operation S404, the method determines whether the selection signal is a TRIAC dimming signal. For example, the signal detection module 145-1 determines whether the selection signal is the TRIAC dimming signal or not. Further, the signal detection module 145-1 counts the number of oscillations output by the oscillator during the one cycle of the distribution voltage $V_A$ to determine whether the selection signal is the TRIAC dimming signal or not.

In operation S405, the method provides a control signal to perform a flicker removal. For example, the control signal supply module 145-2 provides the control signal to the flicker elimination unit 141 provided that the selection signal is not the TRIAC dimming signal. The flicker elimination unit 141 receives the control signal to perform the procedure of the flicker removal. However, if the selection signal is the TRIAC dimming signal, the control signal supply module 145-2 does not provide the control signal to the flicker elimination unit 141.

In operation S406, the method determines whether a dimming signal from the outside source is detected. For example, the dimming level control unit 146 receives the dimming signal from the outside source through the DIM pin. Provided that the dimming level control unit 146 receives the dimming signal from the outside source, the dimming level control unit 146 controls the brightness level of the plurality of LED modules 110 using the analog-dimming level for a pulse width modulation (PWM) dimming level of the dimming signal.

In operation S407, the method controls an amplitude or frequency level of a driving current. For example, the dimming level control unit 146 controls the amplitude level of the driving current based on a condition that the analog-dimming signal is received and controls the amplitude level or frequency level of the driving current upon a condition that the PWM dimming signal is received.

In operation S408, the method determines whether a dimming signal from the inside source is provided. For example, the dimming level control unit 146 receives the dimming signal provided from the inside source.

In operation S409, the method sets an amplitude of the driving current as a predetermined amplitude level. For example, when the dimming level control unit 146 receives the internal dimming signal, that is, there is no external dimming signal, the plurality of LED modules 110 are driven by the driving current that has the predetermined amplitude level.

In operation S410 the method controls a path of the driving current. For example, the driving current control unit 147 controls the driving current based on whether the control signal is provided and the dimming level. The driving current control unit 147 controls a path of the driving current flowing into the plurality of LED modules 110 so as to cause the driving current to flow into all or some of the plurality of LED modules 110.

The spatially-relative expressions such as "below", "beneath", "lower", "above", "upper", and the like may be used to conveniently describe relationships of one device or elements with other devices or among elements. The spatially-relative expressions should be understood as encompassing the direction illustrated in the drawings, added with other directions of the device in use or operation. Further, the device may be oriented to other directions and accordingly, the interpretation of the spatially-relative expressions is based on the orientation.

The apparatuses and units described herein may be implemented using hardware components. The hardware components may include, for example, controllers, sensors, processors, generators, drivers, and other equivalent electronic components. The hardware components may be implemented using one or more general-purpose or special purpose computers, such as, for example, a processor, a controller and an arithmetic logic unit, a digital signal processor, a microcomputer, a field programmable array, a programmable logic unit, a microprocessor or any other device capable of responding to and executing instructions in a defined manner. The hardware components may run an operating system (OS) and one or more software applications that run on the OS. The hardware components also may access, store, manipulate, process, and create data in response to execution of the software. For purpose of simplicity, the description of a processing device is used as singular; however, one skilled in the art will appreciate that a processing device may include multiple processing elements and multiple types of processing elements. For example, a hardware component may include multiple processors or a processor and a controller. In addition, different processing configurations are possible, such as parallel processors.

The methods described above can be written as a computer program, a piece of code, an instruction, or some combination thereof, for independently or collectively instructing or configuring the processing device to operate as desired. Software and data may be embodied permanently or temporarily in any type of machine, component, physical or virtual equipment, computer storage medium or device that is capable of providing instructions or data to or being interpreted by the processing device. The software also may be distributed over network coupled computer systems so that the software is stored and executed in a distributed fashion. In particular, the software and data may be stored by one or more non-transitory computer readable recording mediums. The media may also include, alone or in combination with the software program instructions, data files, data structures, and the like. The non-transitory computer readable recording medium may include any data storage device that can store data that can be thereafter read by a computer system or processing device. Examples of the non-transitory computer readable recording medium include read-only memory (ROM), random-access memory (RAM), Compact Disc Read-only Memory (CD-ROMs), magnetic tapes, USBs, floppy disks, hard disks, optical recording media (e.g., CD-ROMs, or DVDs), and PC interfaces (e.g., PCI, PCI-express, WiFi, etc.). In addition, functional programs, codes, and code segments for accomplishing the example disclosed herein can be construed by programmers skilled in the art based on the flow diagrams and block diagrams of the figures and their corresponding descriptions as provided herein.

As a non-exhaustive illustration only, a terminal/device/unit described herein may refer to mobile devices such as, for example, a cellular phone, a smart phone, a wearable smart device (such as, for example, a ring, a watch, a pair of glasses, a bracelet, an ankle bracket, a belt, a necklace, an earring, a headband, a helmet, a device embedded in the cloths or the like), a personal computer (PC), a tablet personal computer (tablet), a phablet, a personal digital assistant (PDA), a digital camera, a portable game console, an MP3 player, a portable/personal multimedia player (PMP), a handheld e-book, an ultra mobile personal computer (UMPC), a portable lab-top PC, a global positioning system (GPS) navigation, and devices such as a high definition television (HDTV), an optical disc player, a DVD player, a Blu-ray player, a setup box, or any other device capable of wireless communication or network communication consistent with that disclosed herein. In a non-exhaustive example, the wearable device may be self-mountable on the body of the user, such as, for example, the glasses or the bracelet. In another non-exhaustive example, the wearable device may be mounted on the body of the user through an attaching device, such as, for example, attaching a smart phone or a tablet to the arm of a user using an armband, or hanging the wearable device around the neck of a user using a lanyard.

While this disclosure includes specific examples, it will be apparent to one of ordinary skill in the art that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

DESCRIPTION OF SYMBOLS

10: AC INPUT POWER
20: POWER SWITCHING ELEMENT
110: PLURALITY OF LED MODULES
120: BRIDGE DIODE
130: TRIAC DIMMER
140: LED DRIVING CIRCUIT
141: FLICKER ELIMINATION UNIT
142: DC INPUT POWER
143: DRIVING POWER GENERATION UNIT
144: OSCILLATOR
145: DRIVING CONTROL UNIT
145-1: SIGNAL DETECTION MODULE
145-2: CONTROL SIGNAL SUPPLY MODULE
146: DIMMING LEVEL CONTROL UNIT
147: DRIVING CURRENT CONTROL UNIT

What is claimed is:

1. A light emitting diode (LED) driving circuit comprising:

a flicker elimination unit configured to perform a flicker removal for LED modules; and a driving control unit configured to pause the flicker removal in response to receiving an AC input voltage through a Triode for Alternating Current (TRIAC) dimmer.

2. The circuit of claim 1, wherein the flicker elimination unit comprises a diode element, a transistor element and a capacitive element.

3. The circuit of claim 2, wherein the flicker elimination unit is configured to improve a power factor by using the capacitive element to reduce a power loss.

4. The circuit of claim 1, wherein the driving control unit comprises:

a signal detection module configured to detect a selection signal received from an internal source or external source; and a control signal supply module configured to provide a control signal for activating the flicker elimination unit based on the detection result of the selection signal.

5. The circuit of claim 4, wherein the signal detection module counts a number of oscillations output by an oscillator during one cycle of an AC input voltage to determine whether the selection signal is a TRIAC dimming signal.

6. The circuit of claim 4, wherein the control signal supply module provides the control signal to activate the flicker elimination unit in response to the selection signal not being a TRIAC dimming signal and does not provide the control signal in response to the selection signal being a TRIAC dimming signal.

7. The circuit of claim 4, wherein the driving control unit selects a TRIAC-dimming mode using the TRIAC dimmer or a flicker-free mode using the flicker elimination unit through the control signal.

8. The circuit of claim 4, wherein the driving control unit controls a path of a driving current flowing into the LED modules.

9. The circuit of claim 1, further comprising:

a dimming level control unit configured to control a brightness level of the plurality of LED modules by controlling a dimming level.

10. The circuit of claim 9, wherein the dimming level control unit receives a dimming signal from an outside source or an inside source in order to control the brightness level of the plurality of LED modules using an analog-dimming level or Pulse Width Modulation (PWM) dimming level of the dimming signal.

11. The circuit of claim 9, wherein the dimming level control unit sets an amplitude of a driving current as a predetermined amplitude level in response to the dimming signal being provided from an internal source.

12. The circuit of claim 9, wherein the dimming level control unit controls an amplitude level of a driving current in response to the dimming signal being an external analog dimming signal and controls an amplitude level or frequency level of the driving current provided that the dimming signal is an external Pulse Width Modulation (PWM) dimming signal.

13. The circuit of claim 9, further comprising:

a driving current control unit configured to control a driving current set based on whether the control signal is provided and based on the dimming level.

14. A light emitting diode (LED) lighting apparatus, comprising:

LED modules;

a bridge diode configured to full-wave rectify an AC input voltage;

a Triode for Alternating Current (TRIAC) dimmer configured to adjust a brightness level of the LED modules; and a LED driving circuit configured to drive the LED modules wherein the LED driving circuit comprises a flicker elimination unit configured to perform a flicker removal for the LED modules; and a driving control unit configured to pause the flicker removal in response to receiving an AC input voltage through the Triode for Alternating Current (TRIAC) dimmer.

15. The light emitting diode (LED) lighting apparatus of claim 14, wherein the LED driving circuit further comprises a dimming level control unit configured to control a brightness level of the LED modules by controlling a dimming level.

16. The light emitting diode (LED) light apparatus of claim 14, wherein the light emitting diode (LED) driving circuit further comprises a driving current control unit configured to control a driving current set based on whether a control signal is provided and a dimming level.

17. A driving method of an light emitting diode (LED) driving circuit comprising:

detecting a selection signal;

determining whether the selection signal is a Triode for Alternating Current (TRIAC) dimming signal; and in response to determining that the selection signal is not a TRIAC dimming signal, providing a control signal to perform flicker removal.

18. The driving method of claim 17, further comprising:

detecting whether a dimming signal is provided from an outside source; and in response to detecting that a dimming signal is provided from an outside source, controlling an amplitude or frequency level of a driving current.

19. The driving method of claim 18, further comprising:

determining whether a dimming signal is provided from an inside source; and in response to determining that a dimming signal is provided from an inside source, setting an amplitude of the driving current to be a predetermined amplitude level.

20. The driving method of claim 19, further comprising:

controlling a path of the driving current.

* * * * *